United States Patent [19]

Papajewski

[11] 4,085,690

[45] Apr. 25, 1978

[54] NEEDLE JOGGING MECHANISMS

[75] Inventor: Reinhold Papajewski, Buchig, Germany

[73] Assignee: The Singer Company, New York, N.Y.

[21] Appl. No.: 697,885

[22] Filed: Jun. 21, 1976

[51] Int. Cl.[2] ..... D05B 3/02

[52] U.S. Cl. ..... 112/158 R; 74/54

[58] Field of Search ..... 112/158 R, 158 A–158 D, 112/157; 74/54

[56] References Cited

U.S. PATENT DOCUMENTS

| | | | |
|---|---|---|---|
| 875,620 | 12/1907 | Parkes | 112/158 R |
| 2,656,729 | 10/1953 | Bellini | 74/54 |
| 2,903,895 | 9/1959 | Larsen | 74/54 |
| 3,083,656 | 4/1963 | Miller | 112/158 R |

*Primary Examiner*—Werner H. Schroeder
*Assistant Examiner*—Peter Nerbun
*Attorney, Agent, or Firm*—Edward W. Goodman; Edward L. Bell; Robert E. Smith

[57] ABSTRACT

A needle jogging mechanism for zigzag sewing machines which employs an edge cam driven by the main drive of the sewing machine. This cam is embraced by a pair of roller followers each carried on one of a pair of parallel follower levers interconnected by a cross-link the pivotal fastenings of which include eccentrics for adjusting the followers against the cam. An additional link is also provided for transferring the movement of the follower levers to a needle bar gate.

2 Claims, 4 Drawing Figures

NEEDLE JOGGING MECHANISMS

BACKGROUND OF THE INVENTION

All zigzag sewing machines require a device for imparting motion to the needle transverse to the path of material feed. These devices, sometimes referred to as needle jogging mechanisms, operate in a reciprocating motion, most commonly at a repetition rate of one for every two revolutions of the sewing machine drive shaft.

One mechanism used in zigzag sewing machines is disclosed in U.S. Pat. No. 875,620 by Parkes. This mechanism has a yoke embracing an edge cam. The yoke has two flat surfaces, one being adjustable, for following the edge convolutions of the cam. The adjustable side allows for variations due to wear or manufacture. While this mechanism does provide the reciprocating motions needed by the zigzag control mechanism, at the speeds over which industrial machines are run, wear due to the sliding of the cam edge over the yoke and inertia due to the mass of the yoke assembly, become critical factors which limit the effectiveness of the construction disclosed in this Parkes patent.

SUMMARY OF THE INVENTION

It is the primary object of this invention to provide a needle jogging mechanism for a sewing machine in which wear between the cam and follower mechanism is minimized and in which low inertia in the follower mechanism is achieved.

Another object of this invention is to provide a needle jogging mechanism for a sewing machine in which repair and replacement of the entire mechanism is facilitated.

With the above and additional objects and advantages in view, this invention will be described with reference to the accompanying drawings of a preferred embodiment.

DESCRIPTION OF THE PREFERRED EMBODIMENT

Figure 1:
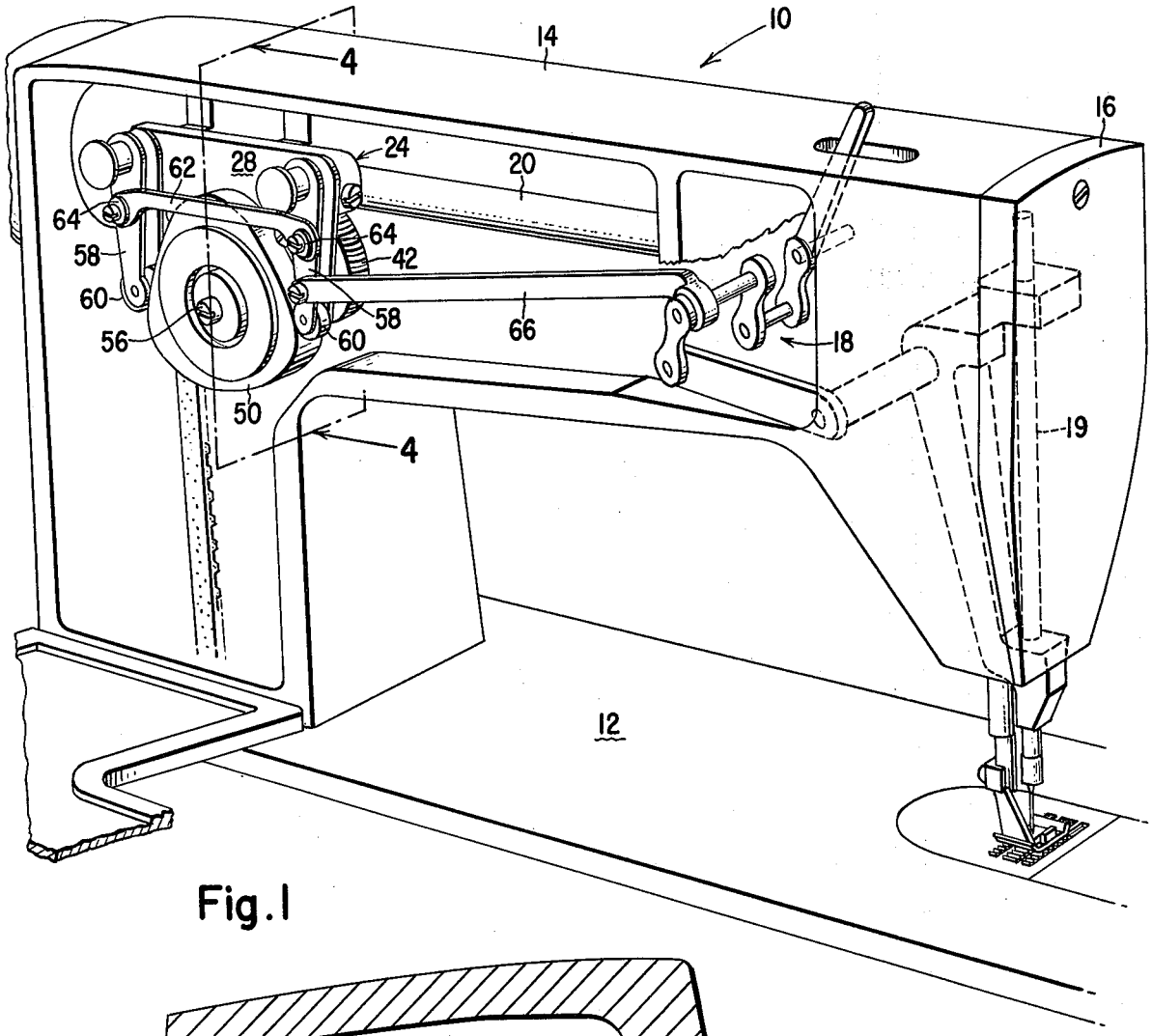
FIG. 1 is a front perspective view of a sewing machine having the arm cover removed showing the needle jogging mechanism of this invention applied thereto.
Figure 4:
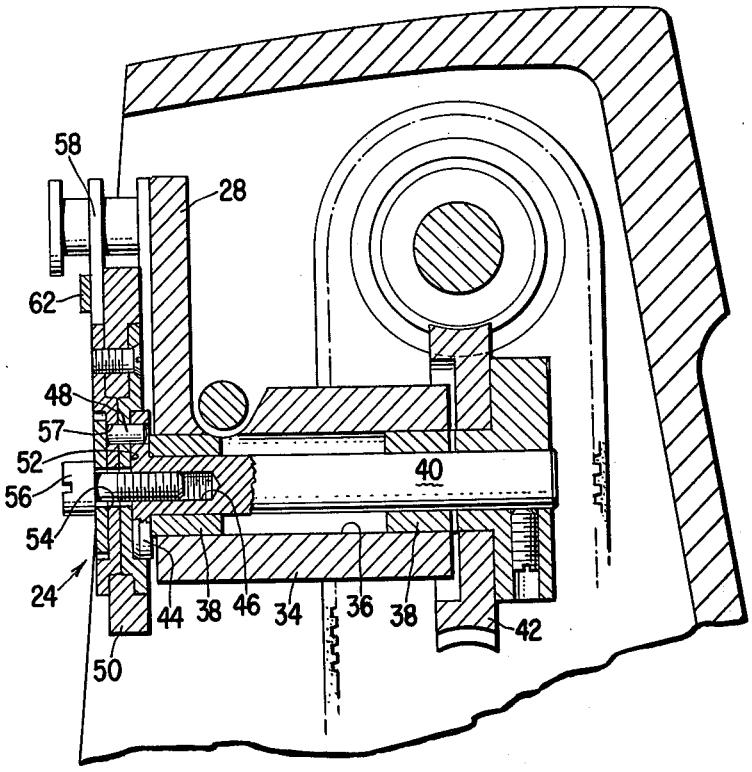
FIG. 4 is a cross-sectional view taken substantially along the line 4—4 in FIG. 1.
Figure 2:
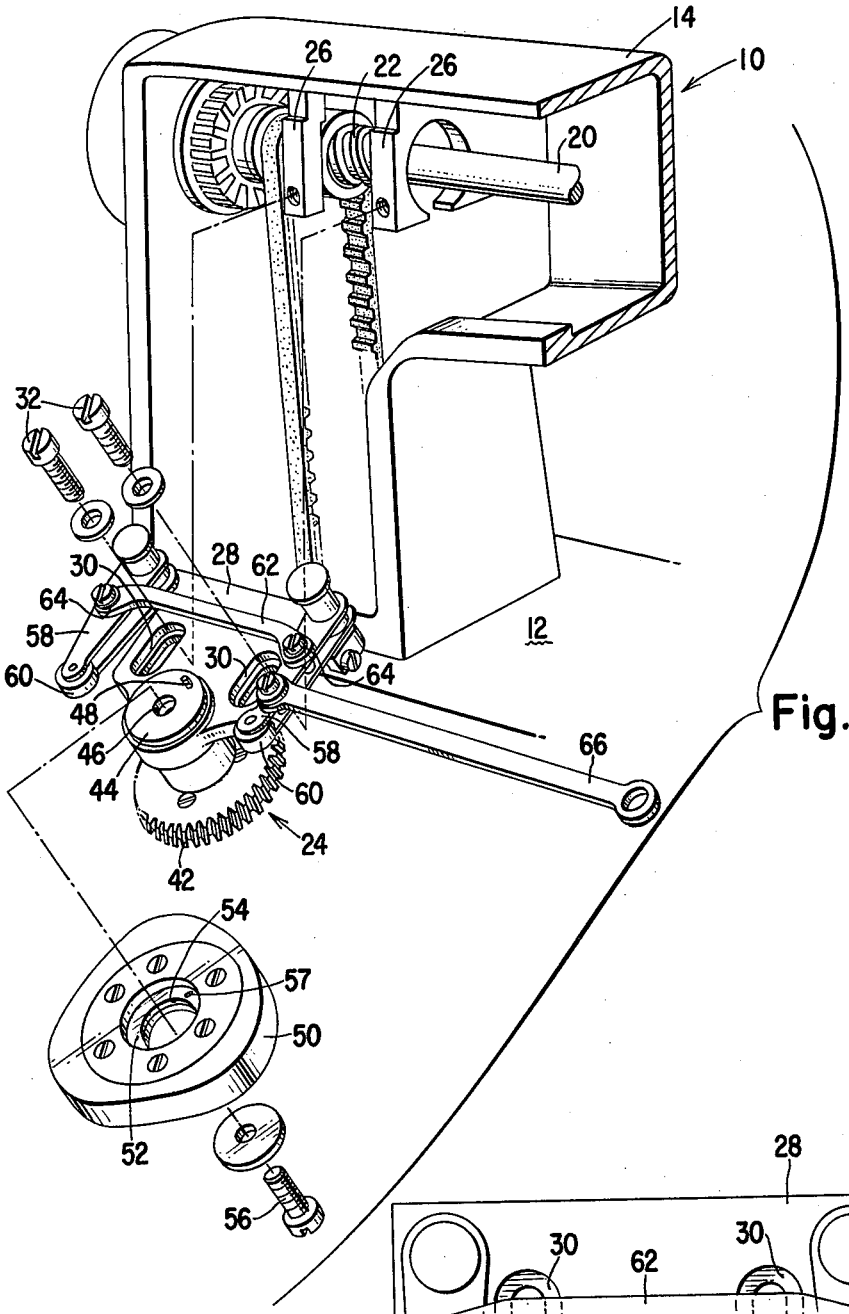
FIG. 2 is a front perspective view of the sewing machine of FIG. 1 showing parts of the needle jogging mechanism detached and exploded.
Figure 3:
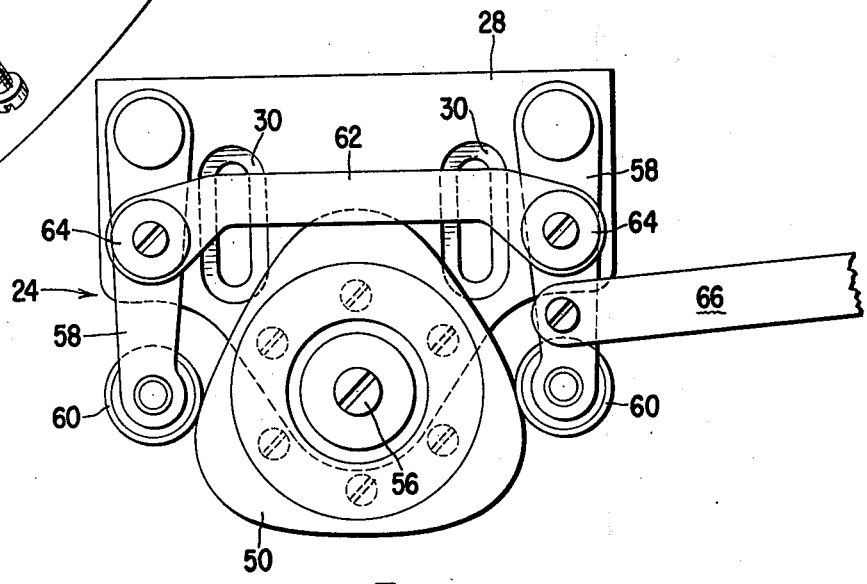
FIG. 3 is a front elevational view of the needle jogging mechanism.

Referring to the drawings for a detailed description of the invention, a sewing machine is generally referred to by the reference number 10. The sewing machine 10 has a base 12 and a bracket arm 14 attached to the base 12. At the free extremity of the bracket arm 14 is a head 16 which contains a zigzag control mechanism 18 and a needle bar 19. Located within the bracket arm 14 is a drive shaft 20 to which is attached a worm gear 22 for driving a needle jogging mechanism 24. Two bosses 26 are provided within the bracket arm 14 for mounting the needle jogging mechanism 24.

The needle jogging mechanism 24 of this invention has a frame 28 having two slots 30 therein for accepting mounting screws 32 which mount the frame 28 to the bosses 26 in the bracket arm 14. At the bottom of the frame 28 is a boss 34 having a bore 36 therethrough. Disposed within the bore 36 and mounted on bushings 38 is a shaft 40. Attached to one of the shaft 40 is a worm wheel 42 which is positioned to engage the worm gear 22 on the drive shaft 20. The ratio between the worm gear 22 and the worm wheel 42 may be varied, but for a plain zigzag pattern using a three-sided cam the drive ration should be 6:1. The other end of the shaft 40 is formed into a cam mounting disc 44. Disposed in the center of the cam mounting disc 44 is a tapped hole 46. Located somewhat off-center of the disc 44 and depending therefrom is a cam indexing post 48 of some small diameter. A cam 50 is provided having a central recess 52 for receiving the disc 44. Centrally located within the recess 52 is a hole 54 through which a mounting screw 56 is placed for engaging the tapped hole 46 in the cam mounting disc 44. Also located within the recess 52 is an indexing hole 57 positioned and sized to receive the indexing post 48 depending from the cam mounting disc 44.

Spaced on opposite sides of the cam 50 are a pair of cam follower levers 58. The follower levers 58 are pivotally mounted at one end to the frame 28 such that the movements of the follower levers 58 are in parallel relation. Attached rotatably to the free ends of the follower levers 58 are a pair of roller cam followers 60. These followers 60 are positioned on the follower levers 58 such that they will traverse the edge of the cam 50. Pivotally attached to each of the follower levers 58 thereby interconnecting them is a cross-link 62. Incorporated in the pivots of the cross-link 62 is a pair of eccentrics 64. These eccentrics 64 allow for adjustment of the follower levers 58 toward and away from each other such that the cam followers 60 can both be caused to be in contact with the cam 50. A linkage arm 66 is pivotally attached to one of the follower levers 58 for transferring the movement of the follower levers 58 to a zigzag control mechanism 18 which is described in co-pending patent application Ser. No. 673,826, filed Apr. 5, 1976.

In the above described embodiment, the cross-link 62 is attached to the same respective sides of the follower levers 58 such that the cam followers 60 will track the same cam, in this instance cam 50. A modification of this invention (not shown) is possible in which the cam comprises two separate cam elements arranged side by side. The cross-link 62 may be attached to opposite respective sides of the follower levers 58 such that one of the cam followers 60 will traverse one of the cam elements and the other cam follower 60 will traverse the other cam element.

Having thus described the nature of the invention, what I claim herein is:

1. In a sewing machine having a base, a bracket arm, a needle bar supported for endwise reciprocation and lateral jogging movement in said bracket arm, and a sewing machine drive shaft in said bracket arm for imparting endwise reciprocation to said needle bar, a needle jogging mechanism comprising:

a. a frame located within said bracket arm and attached thereto;

b. a single cam means rotatably journaled in said frame for rotation about its central axis;

c. means for rotating said cam means in timed relation with said sewing machine drive shaft;

d. a pair of follower levers located on opposite sides of the axis of rotation of said cam means;

e. means for pivotally mounting each of said follower levers at points on said frame spaced from each other;

f. a pair of cam followers rotatably attached one to each of said follower lever for tracking substantially diametrically opposite edges of said single cam means;

g. a cross-link extending from one of said follower levers to said other follower lever;

h. means for pivotally mounting said cross-link to each of said follower levers such that said cross-link influences parallel motion of said follower levers in response to the tracking of said cam means by said cam followers;

i. means for adjusting said cam followers toward and away from each other to compensate for wear and variations in the manufacture of said cam means while maintaining a tracking relation on substantially diametrically opposite sides of said cam means; and j. means for transferring the parallel motion of said follower levers to said needle bar for moving said needle bar transversed to the direction of material feed.

2. A needle jogging mechanism as set forth in claim 1 wherein said adjusting means is provided by said pivotal means (h) in that at least one of said pivotal means (h) comprises a pivot stud formed with adjacent eccentric portions, one portion journaled in one of said follower levers and the other portion in said cross-link; and means for selectively positioning said pivot stud such that said adjustment of said cam followers may be performed.

* * * * *